United States Patent [19]

Strout

[11] Patent Number: 5,002,018

[45] Date of Patent: Mar. 26, 1991

[54] UMBRELLA SEAL FOR AN AUTOMOBILE VALVE STEM

[75] Inventor: Donald W. Strout, Merion, Pa.

[73] Assignee: Enginetech, Inc., Dallas, Tex.

[21] Appl. No.: 432,538

[22] Filed: Nov. 7, 1989

[51] Int. Cl.[5] ..... F01L 3/00

[52] U.S. Cl. ..... 123/188 P; 123/188 SC

[58] Field of Search ..... 123/188 P, 188 SC

[56] References Cited

U.S. PATENT DOCUMENTS

| | | | |
|---|---|---|---|
| 2,859,993 | 11/1958 | Estey | 123/188 P |
| 4,509,473 | 4/1985 | Hamparian | 123/188 P |
| 4,773,363 | 9/1988 | Stritzke | 123/188 P |

FOREIGN PATENT DOCUMENTS

| | | | |
|---|---|---|---|
| 8414 | 1/1978 | Japan | 123/188 P |

*Primary Examiner*—E. Rollins Cross

*Attorney, Agent, or Firm*—Ross, Howison, Clapp & Korn

[57] ABSTRACT

An umbrella seal (42) for a valve stem includes an outer cylindrical portion (44) having a diameter larger than the diameter of the valve stem. An upper cylindrical portion (46) is operable to be disposed about the valve stem with an inner cylindrical surface (48) disposed thereabout. A lower cylindrical portion (44) has a diameter larger than the valve stem and is connected to the upper cylindrical portion (46) by a flat section (50). A garter spring (52) is disposed around the outer surface of the upper cylindrical portion (46) in a recess (54). When the inner cylindrical surface (48) is disposed against the surface of the valve stem, the garter spring (52) provides an inwardly directed force thereon. The garter spring (52) expands both radially and tangentially.

4 Claims, 1 Drawing Sheet

UMBRELLA SEAL FOR AN AUTOMOBILE VALVE STEM

TECHNICAL FIELD OF THE INVENTION

The present invention pertains in general to valve seals, and more particularly, to an umbrella-type valve seal utilized with the rebuilding procedure of automobile engines.

BACKGROUND OF THE INVENTION

When an automobile engine is assembled at the factory, the tolerances for valves, including both the valve guide and valve stem, is very tight. Therefore, the parts utilized in the manufacturing environment can be somewhat standardized with the standards yielding very tight tolerances.

When assembling a valve into the engine, it is important that the valve stem fit within predefined tolerances in the valve guide. In addition, a valve seal is provided on the upper end of the valve stem to minimize the amount of oil that runs down the valve stem into the cylinder bore. This can either be a positive seal or an umbrella valve seal. The positive, this valve seal is mounted over the upper end of the valve guide and secured thereto, and provides a wiping action on the valve stem itself. To insure proper operation, the tolerances of all parts involved in the valve assembly are very precise, which tolerances can easily be accommodated in the manufacturing environment. By comparison, the umbrella seal is mounted on the valve stem and reciprocates with the valve.

When an engine is rebuilt, most of the parts in the valve assembly, including the valve guide, the valve stem, etc., are worn and typically must be replaced. Depending upon the wear, utilization of different size valve stems, valve guides, etc. will be required. If the valve assembly were reassembled in the manner in which it was done at the factory, this would require matching tolerances of all the new parts. For example, if a new valve were utilized having a larger diameter valve stem, this would necessitate matching it with a new valve guide of corresponding dimensions, and also require a valve seal of corresponding dimensions. Depending upon the wear involved in the engine to be rebuilt, any one of a plurality of valve dimensions could be utilized. This presents a problem to a rebuilder in that he would be required to stock a large number of parts to accommodate the varying tolerances.

One technique for minimizing the number of parts stocked by a rebuilder is to utilize "universal" parts that can accommodate varying tolerances. This is especially so with respect to the valve seal. One type of seal that has been utilized in rebuilding is that called the "umbrella seal". In normal manufacturing of a new engine, the valve seal is placed down on the valve guide secured thereto to provide a wiping action. The umbrella seal, in contradistinction, is disposed on the valve stem itself and rides up and down with the reciprocating action of the valve stem. The opening in the umbrella seal is made resilient such that it will expand and accommodate a number of different diameters of valve stems. One problem that has been noted with respect to present umbrella seals is that the resilient materials from which they are made wear out as a function of use and heat, and also due to swelling in the presence of oil. Further, the more resilient the umbrella seal is to accommodate various size valve stems, the poorer the quality is. However, to solve this problem by making the umbrella seal more rigid, additional stock is needed to accommodate the various sizes, as a single size only accommodates a limited range of valve stem diameters.

SUMMARY OF THE INVENTION

The present invention disclosed and claimed herein comprises an umbrella seal for being disposed over a valve stem. The umbrella seal comprises a lower cylindrical section having a first thickness with an exterior cylindrical surface and an interior cylindrical surface, the diameter of the interior cylindrical surface being greater than the diameter of the valve stem. An upper cylindrical surface is provided having a second thickness with an exterior cylindrical surface and an interior cylindrical surface, the diameter of the interior cylindrical surface being less than the diameter of the valve stem. The upper cylindrical surface is fabricated from a resilient material that is compressible such that the interior diameter of the interior cylindrical surface can increase to accommodate various-sized valve stems. An interconnecting section is provided which is formed in a plane perpendicular to the longitudinal axis of the valve stem and which is operable to interconnect the upper peripheral edge of the lower cylindrical section with the lower peripheral edge of the upper cylindrical section. A garter member is provided which is disposed about the outer surface of the upper cylindrical section and is operable to resiliently expand both radially and tangentially to hold the upper cylindrical section against the outer surface of the valve stem.

In another aspect of the present invention, a recess is provided in the outer surface of the upper cylindrical section and the garter member is fabricated from a garter spring that fits about the outer surface of the upper cylindrical section within the recess. In yet another aspect of the present invention, the thickness of the lower cylindrical section, the upper cylindrical section, and the interconnecting section are equal. The three sections are fabricated as a single piece from a resilient material.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1A:
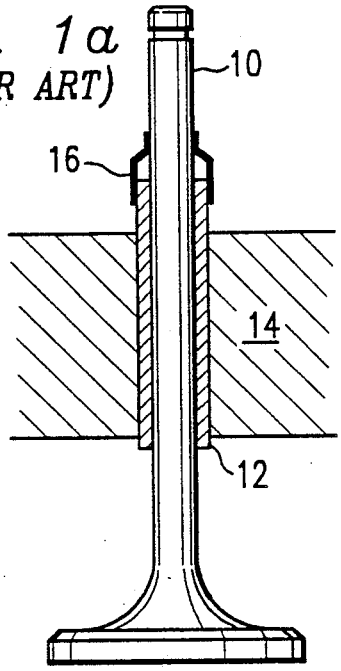
FIG. 1a (PRIOR ART)
FIGS. 1*a* and 1*b* illustrate a fixed valve stem seal of the prior art.
Figure 1B:
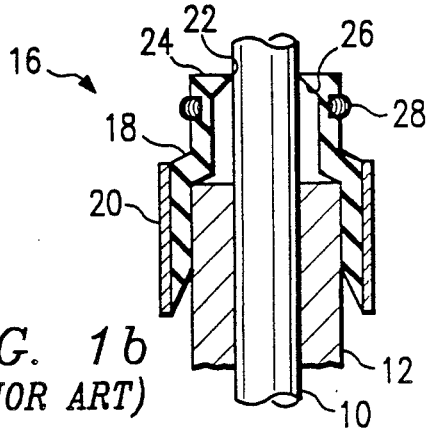
FIG. 1b (PRIOR ART)

Referring now to FIGS. 1*a* and 1*b*, there is illustrated a fixed valve seal of the prior art. FIG. 1*a* illustrates a cross-sectional view of a valve 10 disposed within a valve guide 12. The stem of the valve 10 is operable to reciprocate in close proximity to the interior walls of the valve guide 12. The valve guide 12 is disposed in a holding body 14, such as a cylinder head.

A fixed valve seal 16 is disposed on the upper end of the valve guide 12 and attached thereto. Therefore, when the stem of the valve 10 reciprocates within the valve guide 12, any oil disposed on the upper end of the stem of the valve 10 falls downward. The valve seal 16 is operable to wipe the oil off of the stem of the valve 10. It is important to note that the valve seal 16 is pressed down over the upper end of the valve guide 12 such that it remains stationary with respect to the reciprocating movement.

Referring now to FIG. 1*b*, there is illustrated a cross-sectional diagram of the valve seal 16 of FIG. 1*a*. The valve seal 16 is comprised of a resilient member 18 and a rigid member 20. The rigid member 20 is a cylindrical metal jacket and the resilient member 18 is fabricated from a fluroelastomer. During fabrication, the resilient member 18 is molded with the rigid member 20 in place such that it adheres to the interior walls of the rigid member 20. The interior diameter of the resilient member 18 at the lower end thereof is slightly less than that of the upper end of the valve guide 12. Therefore, when the valve seal 16 is pressed down over the upper end of the valve guide 12, it provides a pressure fit therewith to prevent upward movement. The rigid member 20 is operable to allow compression of the resilient portion 18 to provide the secure fit.

The resilient member 18 has a sealing upper portion, which is comprised of an opening 22. The opening 22 is slightly less than the diameter of the stem of the valve 10 to allow a relatively close fit therewith, this close fit providing the seal. The upper end of the opening 22 has a flat portion 24 on the upper peripheral edges thereof and extending radially outward from the opening 22, the plane of which is perpendicular to the longitudinal axis of the stem of the valve 10. The sealing upper portion of the resilient member 18 has a tapered portion 26 that tapers downward and outward from the opening 22 on the interior walls thereof. This results in an apex being formed between the sides 24 and 26, this apex forming a wiping surface. This shape is primarily functional in nature in that the stem of the valve 10 must be allowed to slide with respect thereto.

Since the upper sealing portion of the valve seal 16 is flexible, it is important to insure that the opening 22 is maintained slightly less than the diameter of the stem of the valve 10 over temperature, age, etc. To insure this, a garter spring 28 is disposed about the periphery of the upper portion of the resilient member 18. This garter spring 28 provides a sufficient inwardly directed force along the radius of the opening 22 to maintain the integrity of the seal without an overly large pressure to allow free reciprocal movement of valve 10.

Figure 2A:
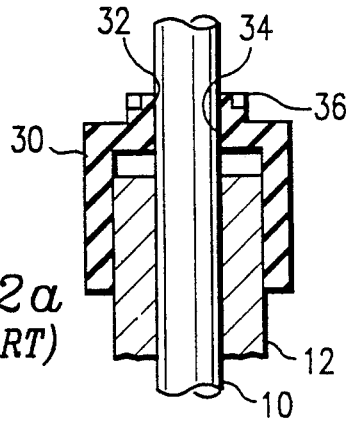
FIG. 2a (PRIOR ART)
FIGS. 2*a* and 2*b* illustrate an umbrella seal of the prior art.
Figure 2B:
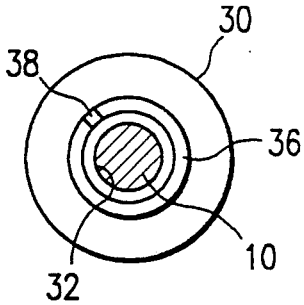
FIG. 2b (PRIOR ART)
Figure 4:
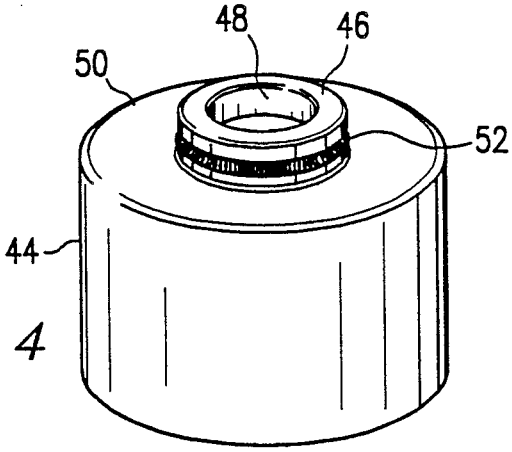
FIG. 4 illustrates a perspective view of the umbrella seal of FIG. 3.

Referring now to FIGS. 2*a* and 2*b*, there is illustrated an example of a prior art umbrella seal. In FIG. 2*a*, there is illustrated a cross-sectional view of the umbrella seal of the prior art illustrated by a reference numeral 30. The umbrella seal 30 is disposed on the stem of the valve 10 at a point slightly above the top of the valve guide 12. The umbrella seal 30 has an opening 32 that is dimensioned slightly less than the diameter of the stem of the valve 10. However, the umbrella seal 30, as compared with the fixed seal 16, has a flat surface 34 about the opening and parallel to the surface of the stem of the valve 10 to provide a seal with respect thereto, but also to provide a secure hold onto the surface thereof.

Functionally, the umbrella seal 30 reciprocates with the stem of the valve 10, as opposed to allowing the stem of the valve 10 to reciprocate therein. Therefore, it is important that the surface 34 maintain a very tight contact with respect to the surface of the stem of the valve 10. This is accomplished in the prior art in two ways. In the first method, a relatively hard plastic material is utilized and sized very closely with respect to the diameter of the stem of the valve 10 and with a slightly smaller diameter. However, since very little compression results, very little deviation in the diameter of the stem of the valve 10 can be tolerated. In addition, there exists the possibility of causing a vertical scratch to appear when the valve seal is installed, this scratch providing a path for oil to pass through. Therefore, a large number of valve stems are required for differing diameters for the stem of the valve 10.

In the second method, illustrated in FIGS. 2*a* and 2*b*, the umbrella seal 30 is fabricated from a resilient material such as nitrile or silicon and a C-ring 36 molded in the outer peripheral edge of the open end 32, the C-ring 36 having a diameter that is larger than the diameter of the stem of the valve 10 or of the opening 32 such that portion of the resilient material is disposed between the opening 32 and the interior peripheral edge of the C-ring 36. The C-ring 36 is operable to flex somewhat to accommodate various diameters of valve stems. Without the C-ring 36, the flexible material from which the umbrella seal 30 is fabricated could fatigue with use and heat, or from oil swelling, and the open end 32 increased in size. In general, the C-ring 36 provides the non-fatiguing portion of the umbrella seal 30, whereas the material from which the umbrella seal 30 is fabricated provides a resilient opening to allow multiple diameter valve stems to be accommodated.

Referring now to FIG. 2*b*, there is illustrated a top view of the umbrella seal 30 of FIG. 2*a* for the prior art. It can be seen that the C-ring 36 has an opening 38 disposed therein, which is formed at the ends of C-ring 36. Therefore, when the C-ring 36 flexes, the radial flex is disproportionate around the peripheral thereof. For example, at a point 40 on the C-ring 36, there is very little tangential movement of the C-ring 36 about its circumference. However, at the opening 38, there is a great deal of tangential movement of the resilient material of the umbrella seal 30. The result is that flexing of the C-ring 36 to accommodate larger diameter valve stem results in cracking or pulling apart of the material from which the umbrella seal 30 is made at the opening 38. Therefore, the C-ring 36 has some significant disadvantages which can cause failures in the field.

Figure 3:
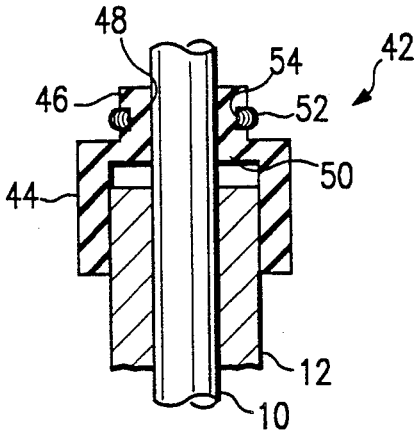
FIG. 3 illustrates a cross-sectional diagram of the umbrella seal of the present invention.

Referring now to FIG. 3, there is illustrated a cross-sectional view of the umbrella seal of the present invention. The umbrella seal is generally referred to by reference numeral 42. The umbrella seal 42 is fabricated from a resilient material such as silicon or nitrile, silicon being the preferred material due to its superior performance at high temperatures. The umbrella seal has a lower section 44 which is cylindrical in shape and significantly greater in diameter than that of the stem of the valve 10. The upper portion of the umbrella seal 42 is comprised of a cylindrical portion 46 having an inner cylindrical surface 48 that is essentially parallel to the outer surfaces of the stem of the valve 10. The lower end of the cylindrical portion 46 and the upper end of the cylindrical portion 44 are connected together by a flat portion 50 that is essentially disposed in a plane perpendicular to the longitudinal axis of the stem of the valve 10.

The inner diameter of the cylindrical portion 46 is slightly less than the smallest diameter valve stems which can be accommodated thereby. Therefore, a slight amount of compression can result when the umbrella seal 42 is disposed down over the valve stem, this compression increasing as the diameter of the valve stem increases for various valve stems. The resilient material will accommodate this and maintain an inwardly directed pressure of the surface 48 against the outer surface of the valve stem. To insure that this pressure is maintained, a garter spring 52 is provided in an arcuate recess 54 on the outer surface of the upper cylindrical portion 46 and disposed above the upper surface of the flat portion 50. The garter spring 52 is operable to provide an inwardly directed force against the outer surface of the upper cylindrical portion 46. The garter spring 52 provides advantages in that it also expands tangentially, thus relieving any stress that may be placed upon the portion of the upper cylindrical section 46 that forms the recess 54. The perspective view of the umbrella seal 42 is illustrated in FIG. 3.

Although the preferred embodiment has been described in detail it should be understood that various changes, substitutions and alterations can be made therein without departing from the spirit and scope of the invention as defined by the appended claims.

What is claimed is:

1. An umbrella seal for being disposed over a valve stem and reciprocal therewith, comprising:

a lower cylindrical section having a first thickness with an exterior cylindrical surface and an inner cylindrical surface, the diameter of said inner cylindrical surface being greater than the diameter of the valve stem;

an upper cylindrical section having a second thickness with an exterior cylindrical surface and an inner cylindrical surface, the diameter of said inner cylindrical surface being less than the outer diameter of the valve stem, said inner cylindrical surface being parallel to the surface of the valve stem;

an intermediate section having a third thickness and formed in a plane perpendicular to the longitudinal axis of the valve stem and dimensioned such that it connects the upper peripheral edge of said lower cylindrical section and the lower peripheral edge of said upper cylindrical section to form a unitary assembly of said lower cylindrical section, said upper cylindrical section and said intermediate section;

said upper cylindrical section fabricated from a resilient material that is compressible such that the diameter of said inner cylindrical surface on said upper cylindrical section increases as said upper cylindrical section is disposed over the valve stem to provide a secure fit with the surface thereof, wherein said inner cylindrical surface of said upper cylindrical section has a pre-defined surface area to provide a gripping function;

a garter spring having a circular shape for being disposed about the outer cylindrical surface of said upper cylindrical section, said garter spring operable to expand both radially and tangentially and fabricated from a spring material having a memory that is greater than that of said upper cylindrical section, the interior diameter of said garter spring being less than the outer diameter of said upper cylindrical section when said garter is in a relaxed state; and said upper cylindrical section including an arcuate recess disposed circumferentially about the outer surface of said upper cylindrical section for receiving said garter spring and holding said garter spring in place.

2. The umbrella seal of claim 1, wherein said upper cylindrical section, said lower cylindrical section, and said intermediate section have the same thickness.

3. The umbrella seal of claim 1 wherein said upper cylindrical section, said lower cylindrical section, and said intermediate section are all fabricated from a resilient material.

4. The umbrella seal of claim 3 wherein said resilient material is a silicone material.

* * * * *